US010017969B2

(12) United States Patent
Och et al.

(10) Patent No.: US 10,017,969 B2
(45) Date of Patent: Jul. 10, 2018

(54) DOOR HANDLE ASSEMBLY FOR AN AUTOMOBILE

(71) Applicant: ILLINOIS TOOL WORKS INC., Glenview, IL (US)

(72) Inventors: Roland Och, Rottendorf (DE); Andreas Rudolf, Wurzburg (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 44 days.

(21) Appl. No.: 14/783,088

(22) PCT Filed: Apr. 2, 2014

(86) PCT No.: PCT/US2014/032625
§ 371 (c)(1),
(2) Date: Oct. 8, 2015

(87) PCT Pub. No.: WO2014/176008
PCT Pub. Date: Oct. 30, 2014

(65) Prior Publication Data

US 2016/0053519 A1 Feb. 25, 2016

(30) Foreign Application Priority Data

Apr. 22, 2013 (DE) ..... 10 2013 006 826

(51) Int. Cl.
*E05B 3/00* (2006.01)
*E05B 85/16* (2014.01)
(Continued)

(52) U.S. Cl.
CPC ..... *E05B 85/16* (2013.01); *E05B 77/06* (2013.01); *E05B 85/12* (2013.01)

(58) Field of Classification Search
CPC ..... Y10T 292/14; Y10T 292/57; E05B 85/12; E05B 85/16; E05B 77/06; Y10S 292/22; Y10S 292/65
(Continued)

(56) References Cited

U.S. PATENT DOCUMENTS 3,153,553 A * 10/1964 Bela Sandor ..... E05B 85/14 292/336.3
3,476,430 A 11/1969 Widmer
(Continued)

FOREIGN PATENT DOCUMENTS

CN 201531171 U 7/2010
CN 102216548 A 10/2011
(Continued)

OTHER PUBLICATIONS

ISR and WO for PCT/US2014/032625 dated Jun. 27, 2014.

*Primary Examiner* — Alyson M Merlino
(74) *Attorney, Agent, or Firm* — Hauptman Ham, LLP

(57) ABSTRACT

A door handle assembly for an automobile comprising a grab section being manually actuatable from the outside or the inside of the door of an automobile, which grab section is moveably mounted between a resting position and an opening position on a bearing component to be mounted on the door, and which is connected to an actuating lever, which is also moveably mounted on the bearing component such that the actuating lever upon a movement of the grab section between its resting position and its opening position is also moved between a resting position and an opening position, wherein the grab section is biased into its resting position and wherein the grab section or the actuating lever can be coupled with a lock of the door such that the lock is opened when the grab section is moved from its resting position into its opening position, further comprising a fly weight which is moveably mounted between a releasing position in which
(Continued)

it allows a movement of the grab section into its opening position and at least one locking position in which it effects a locking of the grab section against a movement into its opening position, wherein the fly weight is biased into the releasing position and wherein the fly weight is moved into the locking position when a predefined acceleration acts on the door handle assembly which effects an opening force onto the grab section, wherein the fly weight is a metal ball, wherein a bearing section is provided with a pathway receiving the metal ball, wherein the metal ball is moveable along the pathway between the releasing position and the at least one locking position, and wherein the metal ball in the locking position cooperates directly or via a locking element with the grab section or the actuating lever for locking the grab section.

13 Claims, 4 Drawing Sheets

(51) Int. Cl.
*E05B 77/06* (2014.01)
*E05B 85/12* (2014.01)

(58) Field of Classification Search
USPC ..... 242/107.4 A, 384.6
See application file for complete search history.

(56) References Cited

U.S. PATENT DOCUMENTS 3,857,528 A * 12/1974 Fiala ..... B60R 22/3413 242/384.6
3,944,164 A * 3/1976 Tibbe ..... B60R 22/3413 242/384.6
4,039,158 A * 8/1977 Weman ..... B60R 22/40 242/384.6
4,057,200 A * 11/1977 Ubukata ..... B60R 22/40 242/384.6
4,087,059 A * 5/1978 Lindblad ..... B60R 22/405 242/384.6
4,371,201 A * 2/1983 Stock ..... B25B 13/463 292/336.3
4,522,350 A * 6/1985 Ernst ..... B60R 22/405 242/384.6
4,597,544 A * 7/1986 Fohl ..... B60R 22/46 242/384.6
6,382,688 B1 5/2002 Agostini
6,471,262 B1 10/2002 Schwab
7,665,776 B2 * 2/2010 Lang ..... E05B 85/16 292/336.3
8,191,953 B2 * 6/2012 Simon ..... E05B 77/06 292/DIG. 22
8,602,344 B2 * 12/2013 Wahl ..... B60R 22/40 242/384.6
2009/0085360 A1 4/2009 Bertolotti
2010/0207404 A1 8/2010 Corwin et al.
2011/0241358 A1 10/2011 Washio
2012/0139272 A1 6/2012 Savant et al.
2013/0187394 A1 7/2013 Lesueur et al.
2013/0234455 A1 9/2013 Rocci et al.

FOREIGN PATENT DOCUMENTS

CN 102317558 A 1/2012
CN 102472059 A 5/2012
DE 19858415 A1 6/2000
DE 102006027912 A1 12/2007
DE 102009056538 A1 6/2011
EP 1052354 A2 11/2000
WO 2011051152 A1 5/2011
WO 2012034665 A1 3/2012

* cited by examiner

DOOR HANDLE ASSEMBLY FOR AN AUTOMOBILE

CROSS-REFERENCE TO RELATED APPLICATIONS

The present application is a National Phase of International Application Number PCT/US2014/032625 filed Apr. 2, 2014 and claims priority to German Application Number 10 2013 006 826.6 filed Apr. 22, 2013.

BACKGROUND

The invention relates to a door handle assembly for an automobile comprising a grab section being manually actuatable from the outside or the inside of the door of an automobile, which grab section is moveably mounted between a resting position and an opening position on a bearing component to be mounted on the door, and which is connected to an actuating lever, which is also moveably mounted on the bearing component such that the actuating lever upon a movement of the grab section between its resting position and its opening position is also moved between a resting position and an opening position, wherein the grab section is biased into its resting position and wherein the grab section or the actuating lever can be coupled with a lock of the door such that the lock is opened when the grab section is moved from its resting position into its opening position, further comprising a fly weight which is moveably mounted between a releasing position in which it allows a movement of the grab section into its opening position and at least one locking position in which it effects a locking of the grab section against a movement into its opening position, wherein the fly weight is biased into the releasing position and wherein the fly weight is moved into the locking position when a predefined acceleration acts on the door handle assembly which effects an opening force onto the grab section.

An external door handle assembly is disclosed, for example, in DE 10 2006 027 912 A1. In this case a fly weight is provided, said fly weight being moveable between two end positions, namely a releasing position and a locking position. The fly weight is biased into its releasing position and is moved into the locking position if a predetermined transverse acceleration acts on the automobile which exerts an opening force on the handle, for example in the event of a side impact. The known fly weight has a locking section which in the locking position cooperates with an associated locking surface of a counter bearing section. In the locking position, a pivoting of the door handle in its opening position and thus an undesired opening of the door in the event of a side impact are reliably prevented. However, the known door handle assembly is associated with a structural complexity which is not inconsiderable. A high number of components is required and the weight of the known device is relatively large.

SUMMARY

Proceeding from the prior art, the object of the invention is to provide a door handle assembly of the type mentioned in the introduction which provides a high level of safety with a simple structural design and reduced costs.

The invention solves the object by the subject matter disclosed herein. Advantageous embodiments are provided in the dependent claims, the description and the figures.

For a door handle assembly of the type mentioned in the introduction, the invention solves the object by the fly weight being a metal ball, wherein a bearing section is provided with a pathway receiving the metal ball, wherein the metal ball is moveable along the pathway between the releasing position and the at least one locking position, and wherein the metal ball in the locking position cooperates directly or via a locking element with the grab section or the actuating lever for locking the grab section.

The door handle assembly according to the invention forms an external door handle assembly or an internal door handle assembly of an automobile. The grab section and/or the actuating lever may be pivotably mounted on the bearing component to be arranged on the door, between the resting position and the opening position. However, it is also possible that the grab section and/or the actuating lever are moveable in a different manner on the bearing component, for example in a linear manner between the resting position and the opening position. For opening the door, the grab section is moved, for example pulled, manually from its resting position into its opening position. This also moves the actuating lever into its opening position so that the door lock is unlocked and the door is able to be opened. The grab section may be mounted with its one end, for example moveably, in particular pivotably, on the bearing component and with its other end may be coupled to the actuating lever. It is also conceivable that the actuating lever is biased into its resting position, preferably by means of a spring element, whereby in turn the grab section is biased into its resting position. When moving the grab section and the actuating lever into the opening position thereof and back again, a relative movement may take place between the grab section and the actuating lever. This is not absolutely necessary, however. In particular, it is also possible that the grab section and the actuating lever do not form separate components but are configured in one piece and/or integrally connected together.

According to the invention, the fly weight is formed by a metal ball, for example a steel ball. It is guided in a pathway of a bearing section. The bearing section may be part of a separate bearing housing. However, it is also possible that the bearing section is, for example, part of the bearing component. In a manner known per se, the inertial force is utilized in order to prevent, for example, undesired opening of the door in the event of a side impact on the automobile. With a sufficiently large impulse and/or a sufficiently high acceleration on the door handle as in the event of a side impact (for example greater than 5 g) the metal ball runs along the pathway from its releasing position into its locking position, driven by the inertial force. The releasing position and the locking position may in each case be end positions on the pathway. Below the predetermined acceleration, the metal ball does not move into the locking position but remains at least sufficiently long in its releasing position that an opening of the door is possible. By a suitable choice of the predetermined acceleration, it may thus be ensured that, with an oblique position of a parked automobile or, for example, with an automobile lying on its side after an accident, an opening of the door is possible in a reliable manner. The movement of the metal ball into its locking position which takes place with the occurrence of sufficient acceleration is sufficiently rapid that the locking of the grab section is effected before the grab section or the actuating lever start to move in their opening position or at least before an unlocking of the door lock takes place via the grab section or the actuating lever. It is thus ensured that, in the event of a crash, the doors of the automobile are not able to spring open inadvertently. If the metal ball subsequently moves back into its releasing position, the locking of the grab section and/or the actuating lever is released so that an opening of the door is possible. It is also possible that the metal ball remains held in its locking position, for example by clamping, and may be released from its locking position, for example by manually pressing on the grab section.

The metal ball provided according to the invention directly effects the locking of the door handle against opening. Either the metal ball acts to this end directly on the grab section or the actuating lever or indirectly via a suitable locking element. However, no further locking mechanism is required, said locking mechanism being triggered by the metal ball and only then effecting the locking of the door handle. The forces able to be transmitted by the metal ball are sufficient in order to lock securely the door handle in the event of a crash. The metal ball is thus not simply a trigger for the locking action but effects the locking itself. As a result, the structural design of the door handle assembly is simplified. The number of components required for the reliable implementation of the locking function is lower than in the prior art and thus also a lower weight results. In addition, a cost saving is achieved.

According to an embodiment, the metal ball may be biased into the releasing position by gravity when the door handle assembly is mounted on an automobile. This relates to the mounted state on an automobile, when the automobile is positioned on horizontal ground. Alternatively or additionally, the metal ball may also be biased into the releasing position by a spring element. Even in oblique positions of the automobile, therefore, it is ensured that the metal ball remains in its releasing position, apart from in the relevant crash case. For example, a helical spring may be provided as a spring element, said helical spring being supported at its one end on the bearing section, for example in the region of the pathway end associated with the locking position. The opposing end of the helical spring then presses against the metal ball. When adopting the locking position, the metal ball compresses the helical spring. Such a spring element does not influence the movement of the grab section or of the actuating lever.

According to a further embodiment, the grab section or the actuating lever may comprise a locking surface with which the metal ball cooperates directly or indirectly via the locking element for locking the grab section. The locking surface may, for example, be a plastics surface in order to achieve by means of increased friction a particularly reliable actuation of the metal ball and/or the locking element in the locking position. The locking surface may be part of a locking block made of plastics or the like, connected to the grab section or the actuating lever. For improving the engagement of the metal ball and/or the locking element in the locking surface, the locking surface may comprise a surface with a corrugated or saw tooth-shaped cross section. Naturally, the locking surface may also have a smooth surface.

According to a further embodiment, it may be provided that the pathway is inclined at least in sections such that the distance between the metal ball and the locking surface of the grab section or the actuating lever, which locking surface is facing towards the metal ball, is smaller in the locking position than in the releasing position. As a result, a particularly simple mechanical implementation of the locking action is achieved by the metal ball. However, it is also possible that the base of the pathway in the mounted state of the door handle assembly is not inclined and the distance between the metal ball and the locking surface, therefore, is not altered between the releasing position and the locking position. This may be provided, in particular, when the locking of the grab section is carried out via a suitable locking element.

The metal ball may push against the locking surface of the grab section or the actuating lever in its locking position such that the grab section (optionally via the actuating lever) is locked against a movement into its opening position. The metal ball in this embodiment, therefore, pushes directly against the locking surface in its locking position and clamps the grab section and/or the actuating lever such that said grab section and/or actuating lever are not able to adopt the opening position. A clamping roller principle is substantially used.

According to a further embodiment, it may be provided that a locking cam pivotably mounted on the bearing section is provided as a locking element, which locking cam is pivoted from a resting position into at least one actuating position through a movement of the metal ball from its releasing position into its locking position, in which actuating position the locking cam engages into the locking surface of the grab section or the actuating lever with a locking projection for locking the grab section. The locking cam may be curved, for example it may be configured to be hook-shaped or sickle-shaped. The locking cam is pivotably mounted with its one end on the bearing section. The other end may be free. The locking cam may have a tooth-shaped projection which in the actuating position engages in the surface of the locking surface which, for example, is corrugated or saw tooth-shaped. The locking cam may be biased into its resting position. The biasing may be provided, for example, by a suitable spring element. If the metal ball moves back into its releasing position, due to the biasing the locking cam is thus also moved back and releases the grab section. It may be provided here that the locking cam biases the metal ball into the releasing position. The locking cam in this embodiment, therefore, serves, on the one hand, as a locking element for locking the grab section and, on the other hand, for biasing the metal ball into its releasing position. In a particularly simple manner, therefore, only one component is required for these functions.

According to a further embodiment, it may be provided that a locking element forming the bearing section and having a C-shaped cross section is provided as a locking element, wherein through a movement of the metal ball from its releasing position into its locking position at least one leg of the locking element with the C-shaped cross section is elastically bent away from the opposite leg, wherein the at least one leg being bent away engages into the locking surface of the grab section or the actuating lever for locking the grab section. The locking surface may, for example, have a locking projection in which the leg which is bent away engages. The locking element which is C-shaped in cross section may, for example, consist of plastics material and is received in a suitable receiver of a bearing housing. The pathway for the metal ball in this exemplary embodiment is formed by the C-shaped locking element.

According to a further embodiment, it may be provided that an elastic spring element being fixed with a first end section on the bearing section is provided as a locking element, which spring element through a movement of the metal ball from its releasing position into its locking position is bent from a resting position into at least one actuating position, in which actuating position the spring element engages into the locking surface of the grab section or the actuating lever with a second free end section for locking the grab section. The free end section of the spring element may be bent or straight in the resting position. The opposing end section of the spring element is fastened to the bearing section. By the metal ball moving into its locking position, the spring element is elastically bent from its resting shape into an actuating shape in which it engages with its free end section in the locking surface and thus locks the grab section and/or the actuating lever against opening. If the metal ball moves back into the releasing position, the spring element again adopts its resting shape and thus releases the door handle.

According to a further embodiment, the elastic spring element may biase the metal ball into the releasing position. The spring element in this embodiment serves, therefore, on the one hand, as a locking element for locking the grab section and, on the other hand, for biasing the metal ball into its releasing position. As a result, a particularly simple construction results as only one component is required for the locking and biasing of the metal ball. According to a particularly expedient embodiment, the elastic spring element may be an elastic leaf spring.

As already mentioned, the locking surface of the grab section or of the actuating lever may be configured to be corrugated or saw tooth-shaped. Thus, the locking projection of the locking cam and/or the locking element with the C-shaped cross section and/or the free end section of the elastic spring element may be, in particular, in a form-fit engagement with the locking surface in the actuating position. This results in particularly secure locking.

According to a further embodiment, it may be provided that the metal ball is moveable from its releasing position along the pathway in two or more directions into two or more locking positions, in which the locking element engages the locking surface of the grab section or the actuating lever for locking the grab section. The respective locking element in this embodiment, therefore, also has two or more actuating positions. The metal ball may move, in particular in two opposing directions, into its two locking positions. In this embodiment, an impulse and/or an acceleration in two opposing directions in each case leads to a locking of the grab section. The safety is further increased as a result, as in the event of a side impact from both sides of the automobile it is ensured that no doors are able to open inadvertently. The base of the pathway for the metal ball in this embodiment, for example, may have the greatest depth in a central section which receives the metal ball in its releasing position, wherein proceeding from the central section the base in each case rises in, for example, opposing directions. This rise then leads to the locking of the grab section when the metal ball runs in this direction.

The invention also relates to a door handle assembly according to the invention in the state mounted on an automobile. In particular, the invention also relates to an automobile comprising at least one door handle assembly, in particular a plurality of door handle assemblies, of the type according to the invention.

BRIEF DESCRIPTION OF THE DRAWINGS

Exemplary embodiments of the invention are described in more detail hereinafter with reference to the figures, in which, schematically.

DESCRIPTION OF SOME EMBODIMENTS

Figure 1:
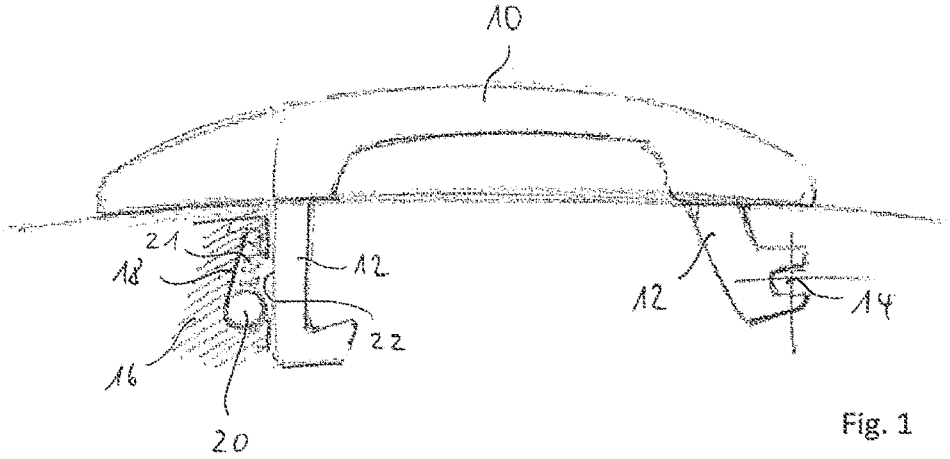
FIG. 1 shows a door handle assembly according to the invention in a sectional view according to a first exemplary embodiment.

An external door handle assembly for an automobile according to the invention is shown in FIG. 1. The external door handle assembly comprises a grab section 10 to be actuated manually from the outside of the door of the automobile, said grab section being connected to an actuating lever 12. The actuating lever 12 is pivotably mounted about an axis shown in FIG. 1 with the reference numeral 14, on a bearing component, not denoted further. In FIG. 1 the resting position of the grab section 10 is shown. If the grab section 10 is pulled manually to the outside, it pivots together with the actuating lever 12 clockwise about the axis 14, wherein the section of the actuating lever 12 shown to the left in FIG. 1 moves upwardly in FIG. 1. The actuating lever 12 is coupled in the example shown to a door lock, so that the door lock in the opening position of the grab section 10 and/or the actuating lever 12 is unlocked and the door is able to be opened.

In FIG. 1 to the left adjacent to the section of the actuating lever 12 shown on the left-hand side, a bearing housing 16 forming a bearing section may be seen in detail in which a pathway 18 for a metal ball 20 is formed. The metal ball 20 is biased by a helical spring 21 into the releasing position shown in FIG. 1. In this releasing position, the section of the actuating lever 12 shown to the left in FIG. 1 is able to move unhindered out of the resting position shown in FIG. 1 upwardly into the opening position. If, for example, due to a side impact a transverse acceleration in FIG. 1 occurs from top to bottom, in FIG. 1 the metal ball 20 runs upwardly along the pathway 18, driven by the inertial force, compressing the helical spring 21. It may be seen that the base of the pathway 18 is inclined such that the distance between the metal ball 20 and a locking surface 22 of the actuating lever 12 facing said metal ball reduces with a movement of the metal ball 20 from its resting position shown in FIG. 1 upwardly into a locking position. In particular, the metal ball in its locking position presses against the locking surface 22 of the actuating lever 12 such that the grab section 10 is locked against a movement into its opening position.

Figure 2:
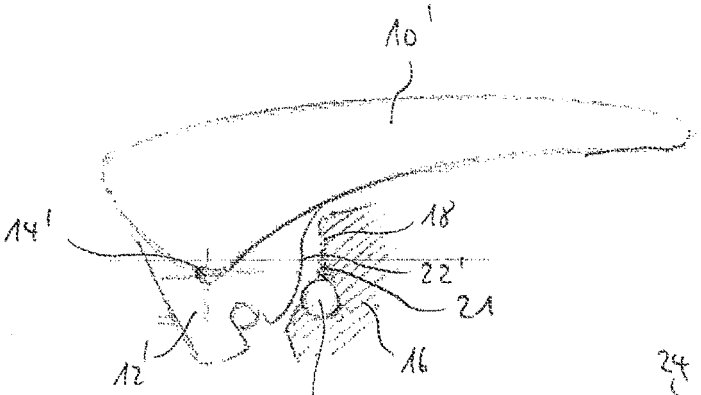
FIG. 2 shows a door handle assembly according to the invention in a sectional view according to a further exemplary embodiment.

A similar application for an internal door handle is shown in FIG. 2. The grab section provided in this case on the inside of an automobile door is shown in FIG. 2 with the reference numeral 10'. The grab section 10' is connected in turn to an actuating lever 12' and the actuating lever 12' is pivotable together with the grab section 10' about an axis shown in FIG. 2 by the reference numeral 14'. A locking surface of the actuating lever 12' may be identified by the reference numeral 22'. In turn, a bearing housing with a pathway 18 and a metal ball 20 also arranged therein may be identified by the reference numeral 16, said metal ball in turn being biased by a helical spring 21 into the releasing position shown in FIG. 2.

The function of the door handle assembly in FIG. 2 is to this extent identical to the door handle assembly shown in FIG. 1. For example, with the occurrence of transverse acceleration in FIG. 2 from top to bottom, the metal ball 20 moves due to the inertial force against the biasing of the helical spring 21 upwardly and thus blocks a pivoting of the actuating lever 12' and thus the grab section 10' so that the grab section 10' is not able to move into its opening position. In both exemplary embodiments, therefore, an inadvertent opening of the door in the event of a crash is avoided.

Further exemplary embodiments of the invention are to be described with reference to FIGS. 3 to 10. In this case, the exemplary embodiment shown in FIGS. 3 and 4 corresponds with regard to its function to the exemplary embodiments shown in FIGS. 1 and 2. In the enlarged views the bearing housing may be identified by the reference numeral 16, said bearing housing having a pathway 18 with an inclined base for receiving the metal ball 20. The metal ball 20 is biased by the helical spring 21 into the releasing position shown in FIG. 3. In the exemplary embodiment shown in FIGS. 3 and 4, an actuating lever of the door handle assembly may be identified by the reference numeral 12. In this case, a locking block 24 made of plastics material is attached to the actuating lever 12, with a locking surface made of plastics material to be identified by the reference numeral 26.

Figure 3:
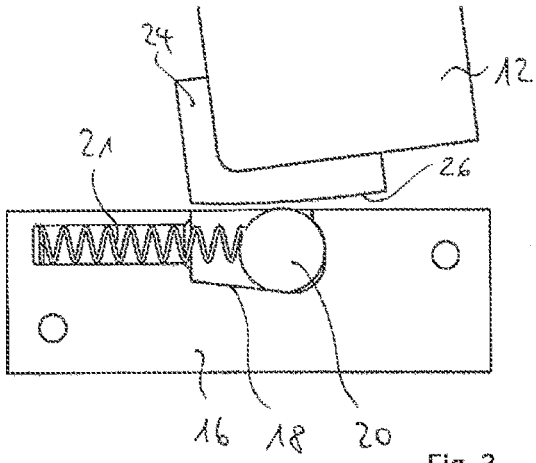
FIG. 3 shows an enlarged detail of a door handle assembly according to the invention in a sectional view and in a first operating state according to a further exemplary embodiment.
Figure 4:
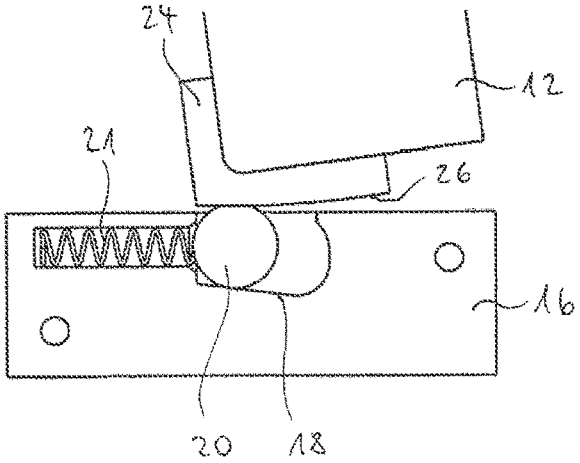
FIG. 4 shows the view of FIG. 3 in a second operating state.

The function of the door handle assembly according to FIGS. 3 and 4 corresponds to the function of the exemplary embodiments of FIGS. 1 and 2. If, proceeding from the operating state in FIG. 3, for example a transverse acceleration from left to right occurs, the metal ball 20 moves to the left due to the inertial force by compressing the helical spring 21. Due to the inclined base of the pathway 18, in this case the metal ball 20 is clamped between the locking surface 26 of the locking block 24 of the actuating lever 12 and the base of the pathway 18 so that the actuating lever 12 is not able to be moved into its opening position.

In the exemplary embodiments according to FIGS. 1 to 4, it may be further provided that the metal ball remains in its locking position due to self-locking. This may be implemented, in particular, by a suitable arrangement, in particular an angled position between the locking surface associated with the pathway inclination and a clamping achieved thereby. The locking action is then maintained until a manual unlocking takes place, in particular by slightly pressing in the grab section and/or the actuating lever, whereby the metal ball is then pressed by the spring again into its releasing position.

Moreover, a cam may be provided on the actuating lever, said cam at the end of the actuation path of the metal ball moving briefly out of the releasing position in order to prevent the metal ball from being fixed.

Figure 5:
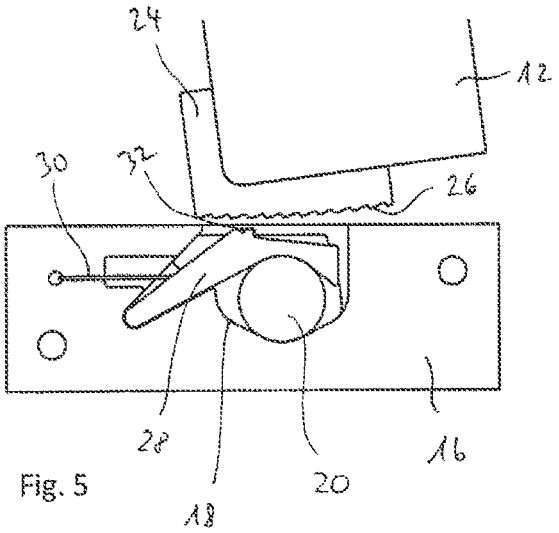
FIG. 5 shows an enlarged detail of a door handle assembly according to the invention in a sectional view and in a first operating state according to a further exemplary embodiment.
Figure 6:
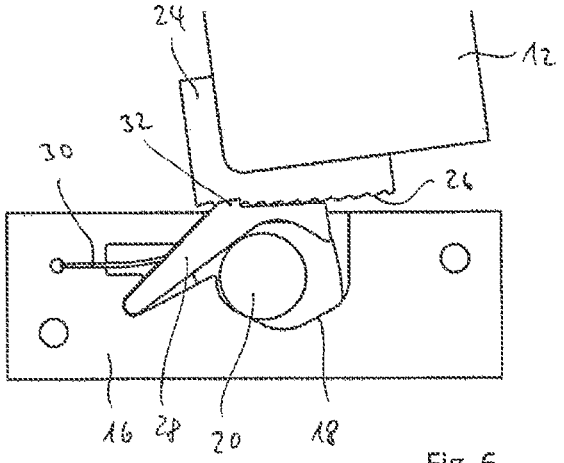
FIG. 6 shows the view of FIG. 5 in a second operating state.

The exemplary embodiment according to FIGS. 5 and 6 differs from the exemplary embodiment of FIGS. 3 and 4 firstly in that the locking surface 26 of the locking block 24 of the actuating lever 12 is of saw tooth-shaped cross section. Secondly, a pathway 18 for the metal ball 20 is configured in the bearing housing 16, said pathway having a central section of greater depth. In this central section, the metal ball 20 is located in its resting position shown in FIG. 5. In FIG. 5, the base of the pathway 18 rises on both sides.

Moreover, it may be identified in FIGS. 5 and 6 that a curved locking cam 28 is provided as a locking element. The locking cam 28 is biased by a spring 30 into the resting position shown in FIG. 5. In this resting position, the locking cam 28 also biases the metal ball 20 into its releasing position. On its upper face facing the locking surface 26, the locking cam 28 has a locking projection 32. With the occurrence of sufficient transverse acceleration, the metal ball 20 is moved to the left or to the right from the resting position shown in FIG. 5, depending on the direction of the transverse acceleration. As a result, as shown in FIG. 6 by way of example for a movement to the left, the locking cam 28 pivots counterclockwise and counter to the biasing of the spring 30, so that the locking projection 32 comes into a form-fit engagement with the locking surface 26 and thus prevents a movement of the actuating lever 12 and thus of the grab section 10 into the opening position.

Figure 7:
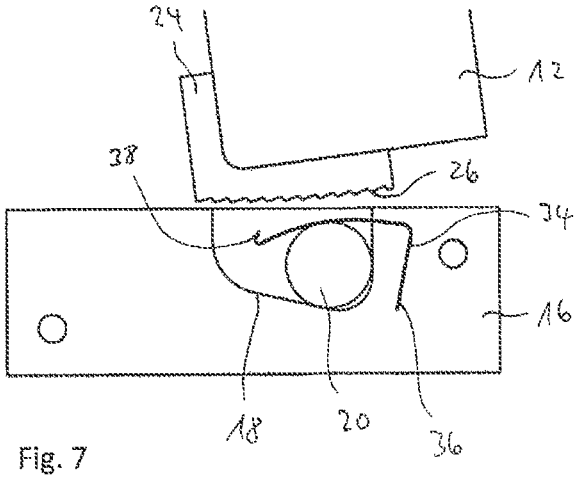
FIG. 7 shows an enlarged detail of a door handle assembly according to the invention in a sectional view and in a first operating state according to a further exemplary embodiment.
Figure 8:
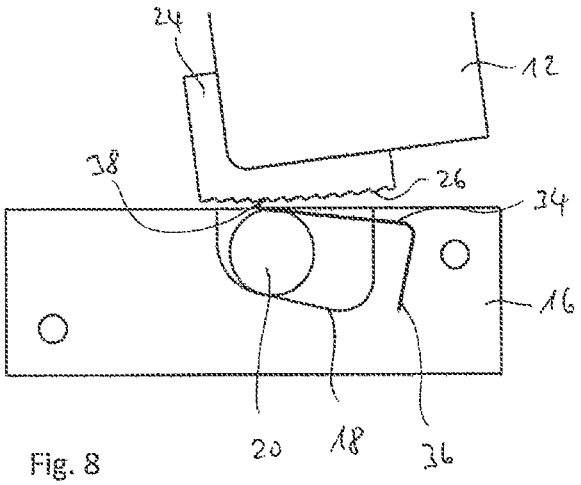
FIG. 8 shows the view of FIG. 7 in a second operating state.

In the exemplary embodiment according to FIGS. 7 and 8, in contrast to the exemplary embodiment of FIGS. 5 and 6, an elastic leaf spring 34 is provided as a locking element. By means of a first end section 36, the leaf spring 34 is arranged fixedly in the bearing housing 16. In FIG. 7, the resting shape of the leaf spring 34 is shown. It may be identified that the leaf spring 34 biases the metal ball 20 into its releasing position shown in FIG. 7, on the inclined pathway 18 of the bearing housing 16. If sufficient transverse acceleration occurs, the metal ball 20 is moved into the locking position shown in FIG. 8, wherein it deforms the leaf spring elastically such that a hook-shaped, curved second end section 38 of the leaf spring comes into a form-fit engagement with the saw tooth-shaped locking surface 26 and thus the actuating lever 12 and thus locks the grab section 10 against a movement into the opening position.

Figure 9:
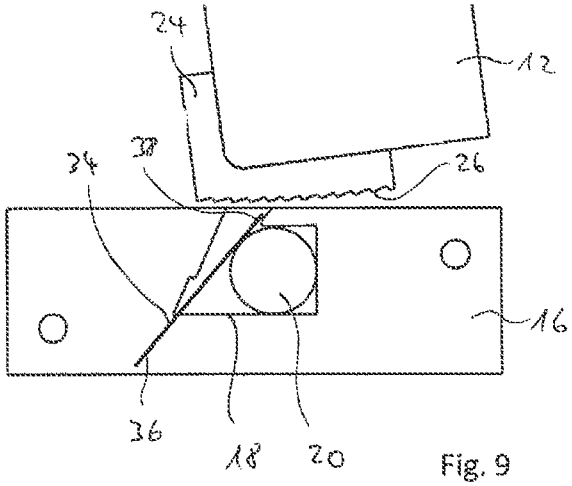
FIG. 9 shows an enlarged detail of a door handle assembly according to the invention in a sectional view and in a first operating state according to a further exemplary embodiment.
Figure 10:
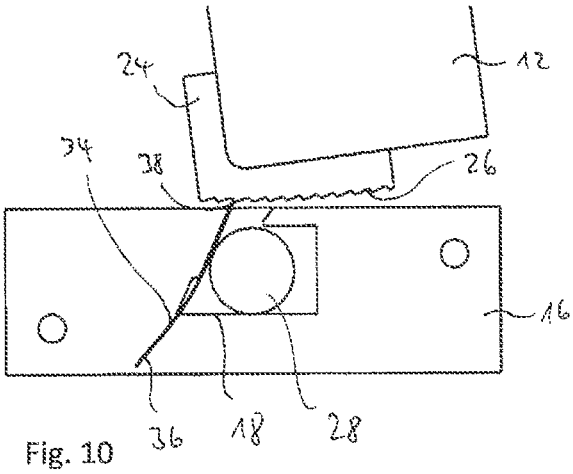
FIG. 10 shows the view of FIG. 9 in a second operating state.

A further exemplary embodiment is shown in FIGS. 9 and 10. Whilst in FIGS. 7 and 8, a leaf spring 34 is provided which, as may be identified in FIG. 7, in its resting position has a bend of approximately 90°, in the exemplary embodiment according to FIGS. 9 and 10, a leaf spring 34 is used as a locking element which in its resting position shown in FIG. 9 runs in a linear manner. Once again, the leaf spring 34 is fixedly arranged in the bearing housing 16 by means of a first end section 36. In the resting position shown in FIG. 9, the leaf spring 34 biases the metal ball 20 into its resting position on the, in this case planar, base of the pathway 18. As in the exemplary embodiment according to FIGS. 7 and 8, in this resting position the leaf spring 34 is not in contact with the locking surface 26 which faces said leaf spring. If due to sufficient transverse acceleration, the metal ball 20 moves to the left on the pathway 18, it bends the leaf spring 34 in an elastic manner so that said leaf spring, as may be identified in FIG. 10, is curved and with its second end section 38 comes into a form-fit engagement with the locking surface 26 and thus in turn prevents the movement of the actuating lever 12 and thus of the grab section 10 into the opening position.

Figure 11:
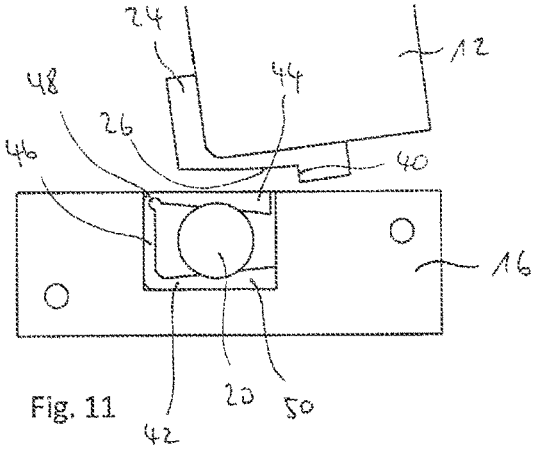
FIG. 11 shows an enlarged detail of a door handle assembly according to the invention in a sectional view and in a first operating state according to a further exemplary embodiment.
Figure 12:
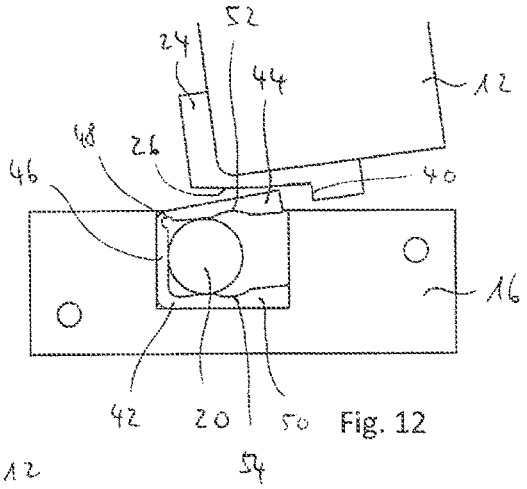
FIG. 12 shows the view of FIG. 11 in a second operating state.
Figure 13:
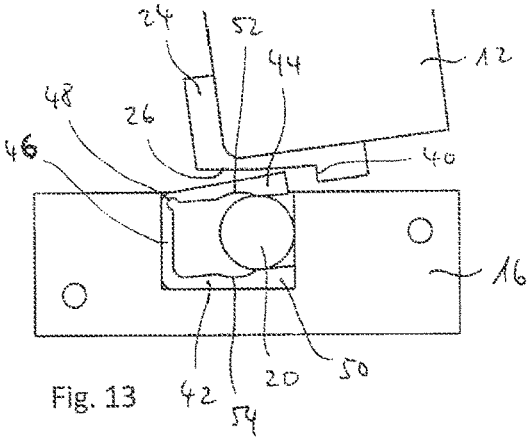
FIG. 13 shows the view of FIG. 11 in a further operating state.

A further exemplary embodiment of the invention is shown in FIGS. 11 to 13. In this exemplary embodiment, firstly it may be identified that the locking surface 26 of the locking block 24 of the actuating lever 12 has a locking projection 40. It may also be identified that in this exemplary embodiment a locking element 42 which is C-shaped in cross section is arranged in the bearing housing 16. The C-shaped locking element 42 in the example shown consists of a plastics material, wherein in the example shown at least the leg 44 facing the actuating lever 12 in the mounted state is elastically moveable. To this end, a recess 48 is provided in the region of the transition of the leg 44 to the bottom face 46 of the locking element 42. The leg 44 and the leg 50 opposing said leg in each case have a recess 52, 54 in which the metal ball 20 is received in the resting position shown in FIG. 11. In this resting position, the C-shaped locking element is not deformed and the leg 44 facing the actuating lever 12 terminates flush with the upper face of the bearing housing 16. In this resting position, the actuating lever 12 with its locking projection 40 may be pivoted past the locking element 42 and, in particular, the leg 44.

In FIGS. 12 and 13, two locking positions of this exemplary embodiment are shown. In the locking position of FIG. 12, due to a centrifugal force which is present the metal ball 20 has been moved to the left, wherein the inner faces of the legs 44, 50 form the pathway for the metal ball 20. In FIG. 13, the ball 20 has been moved to the right along the pathway due to a centrifugal force thereagainst. As may be identified in FIGS. 12 and 13, in both locking positions this results in a bending of the upper leg 44 in the figures away from the opposing leg 50. This leads to a widening of the C-shaped locking element 42. The leg 44 facing the actuating lever 12 now protrudes over the surrounding surface of the bearing housing 16 so that with an opening movement the actuating lever 12 bears with its locking projection 40 against the leg 44 and an opening of the door handle is prevented.

Figure 14:
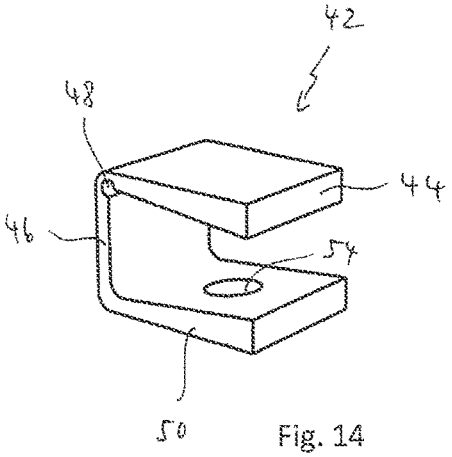
FIG. 14 shows the locking element shown in FIG. 11 in an enlarged perspective view.
Figure 15:
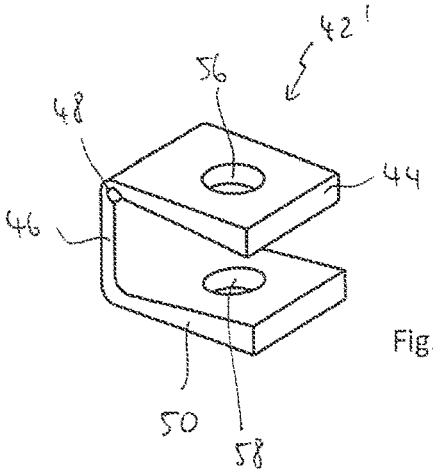
FIG. 15 shows a locking element which is able to be used in FIG. 11 according to a further exemplary embodiment in an enlarged perspective view.

In FIG. 14, the locking element 42 which is C-shaped in cross section and used in FIGS. 11 to 13 is shown for reasons of clarity in an enlarged view. FIG. 15 shows an alternative embodiment of a locking element 42' which is C-shaped in cross section and able to be used in FIGS. 11 to 13. Said locking element 42' corresponds substantially to the locking element 42 shown in FIG. 14. In contrast to the locking element 44 of FIG. 14, in the locking element 42' of FIG. 15, however, in each case a through-hole 56, 58 is formed in the two opposing legs 44, 50 for receiving the metal ball 20 in its resting position. The embodiment according to FIG. 15 corresponds in its function to the embodiment according to FIG. 14. The embodiment according to FIG. 15, however, has advantages in terms of production technology.

In all of the exemplary embodiments a high degree of safety against inadvertent opening of the doors in the event of a crash is achieved in a structurally simple manner and with few components. Moreover, in all of the exemplary embodiments, by a suitable layout of the individual components, in particular the metal ball and the locking elements, it may be ensured that the locking only takes place beyond a predetermined level of acceleration, as occurs in an accident. If the acceleration is reduced, in all of the exemplary embodiments the metal ball 20 moves back again into its releasing position so that an opening of the door is subsequently possible.

The invention claimed is:

1. A door handle assembly for an automobile comprising a grab section being manually engageable from outside or inside of a door of the automobile, the grab section is moveably mounted between an idle position and an opening position on a bearing component mounted on the door, and which is connected to an actuating lever, which is also moveably mounted on the bearing component such that the actuating lever, upon a movement of the grab section between its idle position and its opening position, is also moved between an idle position and an opening position, wherein the grab section is biased into its idle position, and wherein the grab section or the actuating lever can be coupled with a lock of the door such that the lock is placed in an opened state when the grab section is moved from its idle position into its opening position, further comprising a metal ball which is moveably mounted between a releasing position, in which the metal ball allows a movement of the grab section into its opening position, and at least one locking position, in which the metal ball effects a locking of the grab section against a movement into its opening position, wherein the metal ball is biased into the releasing position, and wherein the metal ball is moved into the at least one locking position when a predefined acceleration acts on the door handle assembly, which effects an opening force onto the grab section wherein a bearing section is provided with a pathway for receiving the metal ball, wherein the metal ball is moveable along the pathway between the releasing position and the at least one locking position, and wherein the metal ball in the at least one locking position engages directly or via a locking element with the lever for the locking of the grab section, wherein the actuating lever comprises a locking surface, with which the metal ball engages directly or via the locking element for the locking of the grab section, and wherein the locking element includes a component having a C-shaped cross section, wherein through a movement of the metal ball from its releasing position into its at least one locking position, a first leg of the component with the C-shaped cross section is elastically bent away from a second leg of the component opposite to the first leg, wherein the first leg being bent away from the second leg such that the first leg engages with the locking surface of the actuating lever for the locking of the grab section.

2. The door handle assembly according to claim 1, wherein the metal ball is biased into its releasing position by gravity when the door handle assembly is mounted on the automobile.

3. The door handle assembly according to claim 1, wherein the metal ball is biased into its releasing position by a spring element.

4. The door handle assembly according to claim 1, wherein the locking surface comprises a surface with a corrugated or sawtooth-shaped cross section.

5. The door handle assembly according to claim 1, wherein the pathway is inclined, at least in sections, such that a distance between the metal ball and the locking surface of the actuating lever, when the locking surface is facing towards the metal ball, is smaller in the at least one locking position than in the releasing position.

6. The door handle assembly according to claim 5, wherein the metal ball pushes against the locking surface of the actuating lever in its at least one locking position such that the grab section is locked against a movement into its opening position.

7. The door handle assembly according to claim 1, wherein the locking element includes a locking cam moveably mounted on the bearing section said locking cam is pivoted from an idle position into an engagement position through a movement of the metal ball from its releasing position into its at least one locking position, in which engagement position the locking cam engages with the locking surface of the actuating lever.

8. The door handle assembly according to claim 7, wherein the locking cam biases the metal ball into its releasing position.

9. The door handle assembly according to claim 7, wherein the locking projection of the locking cam is in a form-fit engagement with the locking surface in the engagement position.

10. A door handle assembly for an automobile comprising a grab section being manually engageable from outside or inside of the door of the automobile, the grab section is moveably mounted between an idle position and an opening position on a bearing component mounted on the door, and which is connected to an actuating lever, which is also moveably mounted on the bearing component such that the actuating lever, upon a movement of the grab section between its idle position and its opening position, is also moved between an idle position and an opening position, wherein the grab section is biased into its idle position, and wherein the grab section or the actuating lever can be coupled with a lock of the door such that the lock is placed in an opened state when the grab section is moved from its idle position into its opening position, further comprising a metal ball which is moveably mounted between a releasing position, in which the metal ball allows a movement of the grab section into its opening position, and at least one locking position, in which the metal ball effects a locking of the grab section against a movement into its opening position, wherein the metal ball is biased into the releasing position, and wherein the metal ball is moved into the at least one locking position when a predefined acceleration acts on the door handle assembly, which effects an opening force onto the grab section wherein a bearing section is provided with a pathway for receiving the metal ball, wherein the metal ball is moveable along the pathway between the releasing position and the at least one locking position, and wherein the metal ball in the at least one locking position engages directly or via a locking element with the lever for the locking of the grab section, wherein the actuating lever comprises a locking surface, with which the metal ball engages directly or via the locking element for the locking of the grab section, and wherein the locking element includes an elastic spring element being fixed by a first end section to the bearing section, said spring element, through a movement of the metal ball from its releasing position into its at least one locking position, is bent from an idle position into an engagement position in which the spring element engages with the locking surface of the actuating lever with a second free end section for the locking of the grab section.

11. The door handle assembly according to claim 10, wherein the elastic spring element biases the metal ball into its releasing position.

12. The door handle assembly according to claim 10, wherein the elastic spring element is an elastic leaf spring.

13. A door handle assembly for an automobile comprising:

a grab section being manually engageable from an outside or an inside of a door of the automobile, the grab section is moveably mounted between an idle position and an opening position on a bearing component, the bearing component being configured to be mounted on the door, and which is connected to an engagement lever, which is also moveably mounted on the bearing component such that the engagement lever, upon a movement of the grab section between its idle position and its opening position, is also moved between an idle position and an opening position, wherein the grab section is biased into its idle position, the grab section or the engagement lever is configured to be coupled with a lock of the door such that the lock placed in an opened state when the grab section is moved from its idle position into its opening position, the door handle assembly further comprises a fly weight which is moveably mounted between a releasing position, in which the fly weight allows a movement of the grab section into its opening position, and at least one locking position, in which the fly weight effects a locking of the grab section against a movement into its opening position, wherein the fly weight is biased into the releasing position, and wherein the door handle assembly is configured such that the fly weight is moved into the at least one locking position when a predefined acceleration acts on the door handle assembly, which effects an opening force onto the grab section, the fly weight is a metal ball, a bearing section is provided with a pathway for receiving the metal ball, the metal ball is moveable along the pathway between the releasing position and the at least one locking position, and the metal ball in the locking position engages directly or via a locking element with the engagement lever for the locking of the grab section, wherein the locking element includes a component having a C-shaped cross section, wherein through a movement of the metal ball from its releasing position into its at least one locking position, a first leg of the component with the C-shaped cross section is elastically bent away from a second leg of the component opposite to the first leg, wherein the first leg being bent away from the second leg such that the first leg engages with a locking surface of the actuating lever for the locking of the grab section.

* * * * *